United States Patent [19]

Blank

[11] 4,054,067

[45] Oct. 18, 1977

[54] COMPACT SCREWDRIVER BIT

[75] Inventor: George Blank, Ajax, Canada

[73] Assignee: The Raymond Lee Organization, Inc., a part interest

[21] Appl. No.: 613,116

[22] Filed: Sept. 15, 1975

[51] Int. Cl.[2] ..... B25B 13/00

[52] U.S. Cl. ..... 81/58.1

[58] Field of Search ..... 81/60–63.2, 81/58.1

[56] References Cited

U.S. PATENT DOCUMENTS

| | | | |
|---|---|---|---|
| 505,535 | 9/1893 | Porstendorfer | 81/63.2 |
| 837,537 | 12/1906 | Beyer | 81/62 |
| 1,305,249 | 6/1919 | Buck | 81/58.1 |
| 2,531,722 | 11/1950 | Brubeck | 81/63 X |
| 3,508,455 | 4/1970 | Miller | 81/58.1 |
| 3,575,069 | 4/1971 | White | 81/58.1 |

*Primary Examiner*—James L. Jones, Jr.

[57] ABSTRACT

A compact screwdriver bit which can be operated interchangeably by a known type one way ratchet wrench type driver having a square shaped bit receiving opening or by a known spinner type handle having a bit controlling member. The bit employs an elongated shank having a screwdriver tip at one end and a body at the other end, the body having an axially extending opening. When the wrench type driver is used, the body is fitted into the bit receiving opening. When the screwdriver type driver is used, the bit controlling member is fitted into the opening in the body.

1 Claim, 4 Drawing Figures

COMPACT SCREWDRIVER BIT

BACKGROUND OF THE INVENTION

It is know that a plurality of different screwdriver bits can be used interchangeably with one ratchet type driver. It is also known that a plurality of different screwdriver bits can be used interchangeably with one screwdriver type driver. However the bits used with the ratchet type driver cannot be used with the screwdriver type driver and vice versa whereby a user employing both types of drivers must have two different sets of bits. The present invention overcomes this problem by providing bits which can be used interchangeably with both types of drivers.

SUMMARY OF THE INVENTION

In accordance with the invention, a compact screwdriver bit is adapted for use interchangeably with a ratchet wrench type driver having a square bit receiving opening and with a screwdriver type driver having a bit controlling member which in cross section also defines a square.

The bit employs an elongated shank having a screwdriver tip at one end. The other end of the shank carries an axially aligned cylinder which in cross section has the shape of a square and which will fit detachably in the bit receiving opening. The cylinder has an axially extending bore therein which in cross section defines a square, the bit controlling member fitting detachably in the bore.

Thus in use, when the cylinder fits into the bit receiving opening, the bit can be used with the ratchet wrench type holder while when the member fits in the bore the bit can be used with the screwdriver type holder.

The term "square" is used herein in an exemplary rather than limiting sense. It should be understood that any other polygonal shape can be used in place of a geometric square.

DETAILED DESCRIPTION OF PREFERRED EMBODIMENT

Figure 2:
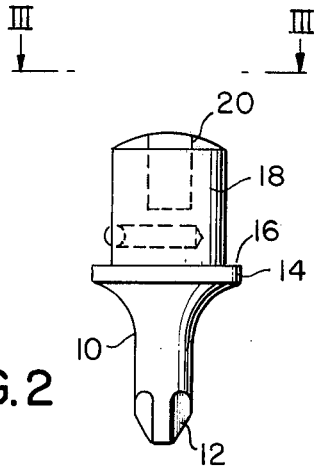
FIG. 2 is a side view of a bit in accordance with the invention.
Figure 3:
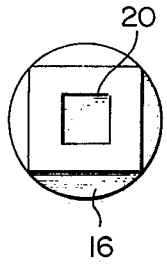
FIG. 3 is a top view of the bit of FIG. 2.
Figure 4:
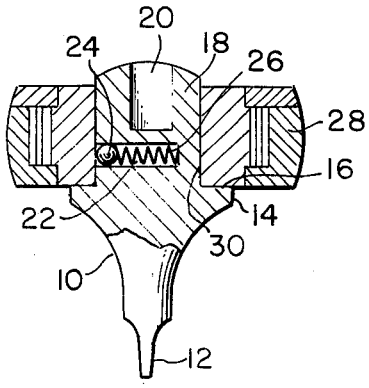
FIG. 4 is a cross-sectional view taken along line 4—4 in FIG. 1.
Figure 1:
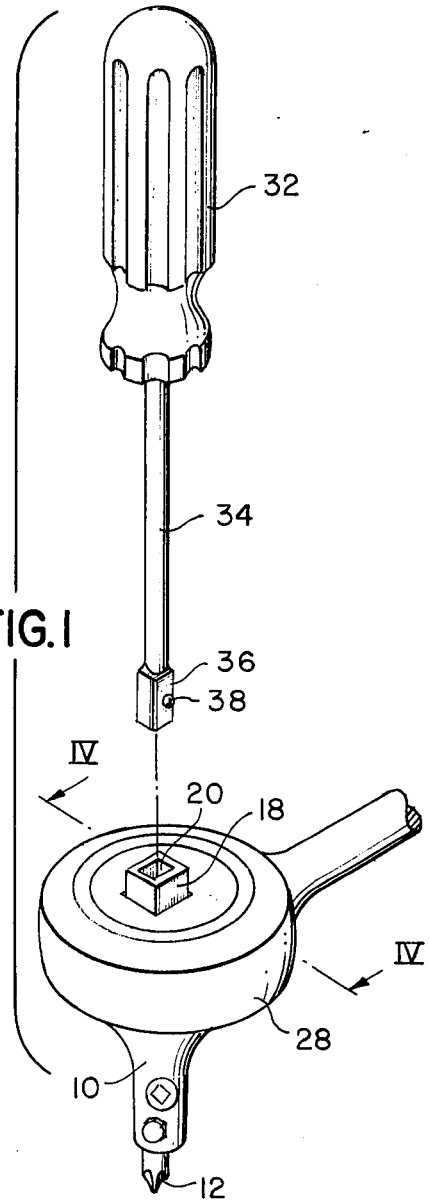
FIG. 1 is an exploded view illustrating use of the invention.

Referring now to FIGS. 1–4, a compact screwdriver bit has a shank 10 of any length which is elongated with respect to its cross-sectional area and which terminates at one end in a screwdriver tip 12. The opposite end of the shank is flared out to a flange 14 having a flat circular surface 16 disposed at right angles to the axis of the shank.

An elongated body 18 defining a cylinder of square cross section has its axis aligned with the axis of the shank and has one end secured to surface 16. The diagonal formed in square cross section is somewhat smaller than the diameter of the flanges. The opposite end of the body is rounded. A bore 20 of square cross section extends axially within the body from the opposite end to a point intermediate the ends. Intermediate the ends of the body, a conventional spring loaded ball is placed to hold body or bit in place.

A known type one way ratchet wrench type driver 28 has a square shaped opening 30 slightly larger than the square cross section of body 18 whereby the body can be disposed detachably therein for use as described.

Known spinner type driver has handle 32 with shank 34 of any length terminating in bit controlling member 36 of square cross section which can fit slidably into bore 20. Member 36 has the conventional spring loaded ball bearing 38 for pressing against the inner surface of bore 20 to hold the bit in place for use as described to form a common screwdriver.

The ratchet wrench receiving male head member is somewhat longer than the thickness of the ratchet wrench. This permits the upper extremity of the member to extend through and project partially outwardly from the wrench. The outwardly extending portion is conveniently rounded and forms the means of a quick release bottom by applying pressure. In use a compact bit can be used with the handle as a screwdriver. When the screws are difficult to get at or are hard to drive in, the bit can be inserted into the wrench and the handle can be used to apply extra pressure and steady the screw. While the invention has been described in detail with specific reference to the drawings, the protection sought is to be limited only by the terms of the claims that follow.

I claim:

1. A compact screwdriver bit which can be used interchangeably with a ratchet wrench type driver having a square shaped bit receiving opening and with a screwdriver type having a bit controlling member, of square cross section, said bit comprising:

an elongated shank having a screwdriver tip at one end and a flat circular flange at the other end, said flange having a flat surface perpendicular to the axis of the shaft, and centered on the shank, the other end of the shank flaring outward to said flange; and an elongated rectangularly shaped solid body extending in the direction of the shank, one end of the body being secured to said flange and centered on said shaft, said body having a cross sectional shape of a square as viewed in a plane at right angles to the direction of elongation of said body, the other end of said body being rounded, the diagonal of said one end slightly smaller than the diameter of the flange, said body having a longitudinally extending bore centered on said shaft and extending from said other end of the body to a point intermediate both ends of the body, said bore in cross section having the shape of a square, said body fitting detachably into the opening of said driver, said member fitting detachably into said bore.

* * * * *